United States Patent [19]

Johnson et al.

[11] 4,081,042

[45] Mar. 28, 1978

[54] STABILIZER AND ROTARY EXPANSIBLE DRILL BIT APPARATUS

[75] Inventors: Gary R. Johnson, Yorba Linda, Calif.; Archer W. Kammerer, Jr., Tryon, N.C.

[73] Assignee: Tri-State Oil Tool Industries, Inc., Bossier City, La.

[21] Appl. No.: 703,525

[22] Filed: Jul. 8, 1976

[51] Int. Cl.[2] ..... E21B 9/26

[52] U.S. Cl. ..... 175/267; 175/325

[58] Field of Search ..... 175/203, 230, 267, 284, 175/290, 321, 325, 97, 98, 99; 166/206

[56] References Cited

U.S. PATENT DOCUMENTS

| | | | |
|---|---|---|---|
| 2,699,921 | 1/1955 | Garrison | 175/267 |
| 3,123,162 | 3/1964 | Rowley | 175/325 |
| 3,196,960 | 7/1965 | Kammerer | 175/267 |
| 3,370,657 | 2/1968 | Antle | 175/325 X |
| 3,443,648 | 5/1969 | Howard | 175/99 X |
| 3,938,598 | 2/1976 | Watts | 175/99 |

*Primary Examiner*—Ernest R. Purser
*Assistant Examiner*—William F. Pate, III
*Attorney, Agent, or Firm*—Subkow and Kriegel

[57] ABSTRACT

The upper end of a rotary drill bit having initially retracted expansible cutters is connected to a stabilizer having initially retracted expansible stabilizer members, the upper end of the stabilizer being connectable to a rotary drill pipe string. The apparatus is lowered in a bore hole on the drilling string and rotated, the cutters being expanded to cut into the bore hole and enlarge it to a desired diameter, the apparatus being lowered to progressively continue enlarging the hole in a downward direction. Upon the stabilizer moving into the enlarged hole, its stabilizer members are expanded laterally to an extent conforming to the enlarged hole diameter, being engageable with the wall of the bore hole to stabilize the bit therebelow.

20 Claims, 9 Drawing Figures

STABILIZER AND ROTARY EXPANSIBLE DRILL BIT APPARATUS

The present invention relates to the stabilization of drill bits for use in drilling bore holes, and more specifically to stabilizer apparatus for enlarging bore holes produced by drill bits having expandable cutters. The stabilizer portion of the apparatus functions in the enlarged portion of the bore hole to center the expanded cutters of an expandable bit during lengthwise drilling of the enlarged diameter bore hole.

As disclosed in U.S. Pat. No. 2,699,921, a rotary drill bit has expansible cutters thereon adapted to enlarge the diameter of a bore hole. Below this bit a stabilizer device is provided which has stabilizing arms expandable outwardly into engagement with the wall of a pilot hole below and of a much smaller diameter than the enlarged hole being produced by the expansible type of bit. The stabilization that can be effected by such a bit and stabilizer combination is rather limited, primarily because of the small diameter bore hole in which the stabilizer itself is operating, which is substantially less than the diameter of the enlarged hole being produced by the drill bit thereabove.

Stabilizers are known having fixed blades or ribs which can effect their stabilization function in a hole of a predetermined diameter that conforms to the effective diameter of the stabilizing members on the stabilizer itself. It is evident, however, that such a fixed blade or rib stabilizer can have no stabilizing function when introduced into a bore hole of substantially larger diameter than the effective diameter of the stabilizer itself.

In accordance with the present invention, apparatus is provided which is capable of stabilizing a rotary expansible drill bit within an enlarged bore hole being produced by the expanded bit cutters. The stabilizer employs expansible stabilizer arms, blades, or ribs which are positioned above the expanded cutters of the drill bit. The stabilizer is capable of moving through a smaller diameter hole or casing, its stabilizer arms, blades, or ribs then being expandable outwardly into engagement with the wall of the enlarged hole produced by the expansible type of bit mounted in the bore hole below the stabilizer unit. The stabilizer arms have an effective diameter conforming closely to the diameter of the enlarged hole and can bear against the wall of the enlarged hole to an effective extent, to maintain the expansible drill bit coaxial with the original bore hole that the expansible cutters are enlarging, resisting the tendency of the expanded cutters of the bit to drill a misaligned or deviated enlarged hole.

An object of the invention is to provide a stabilizer having arms, ribs, blades or the like that are expandable outwardly from a retracted position to an expanded position for operating in an enlarged hole for the purpose of effecting stabilization of an expansible bit in the enlarged hole.

A further object of the invention is to provide a combination of an expansible drill bit capable of enlarging a bore hole and of a stabilizer having expansible arms thereon adapted to coact with the wall of the enlarged hole for the purpose of stabilizing the bit within the hole.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIGS. 1*a* and 1*b* together constitute a longitudinal section taken along the line 1—1 of FIG. 4, through a combination of an upper stabilizer portion of an apparatus and a lower expansible drill bit portion, the arms of the stabilizer and the cutters of the drill bit both being in their initial retracted position for movement through a well casing located within a previously drilled bore hole, which bore hole extends below the lower end or shoe of the casing, FIG. 1*b* being a lower continuation of FIG. 1*a*.

FIGS. 2*a* and 2*b* are quarter longitudinal sections corresponding to FIGS. 1*a* and 1*b*, respectively, disclosing the cutters of the expansible bit expanded outwardly to their maximum position to drill an enlarged hole, while the arms of the stabilizer have been expanded to a slight extent only to bear against the wall of the well casing or of the previously drilled pilot hole, FIG. 2*b* being a lower continuation of FIG. 2*a*.

FIGS. 3*a* and 3*b* are longitudinal sections conforming to FIGS. 2*a* and 2*b*, respectively, disclosing both the cutters of the expansible drill bit and the arms of the stabilizer expanded outwardly to their fullest extents, FIG. 3*b* being a lower continuation of FIG. 3*a*.

FIG. 5 is a cross-section taken along the line 5—5 of FIG. 1*a.

Figure 1A:
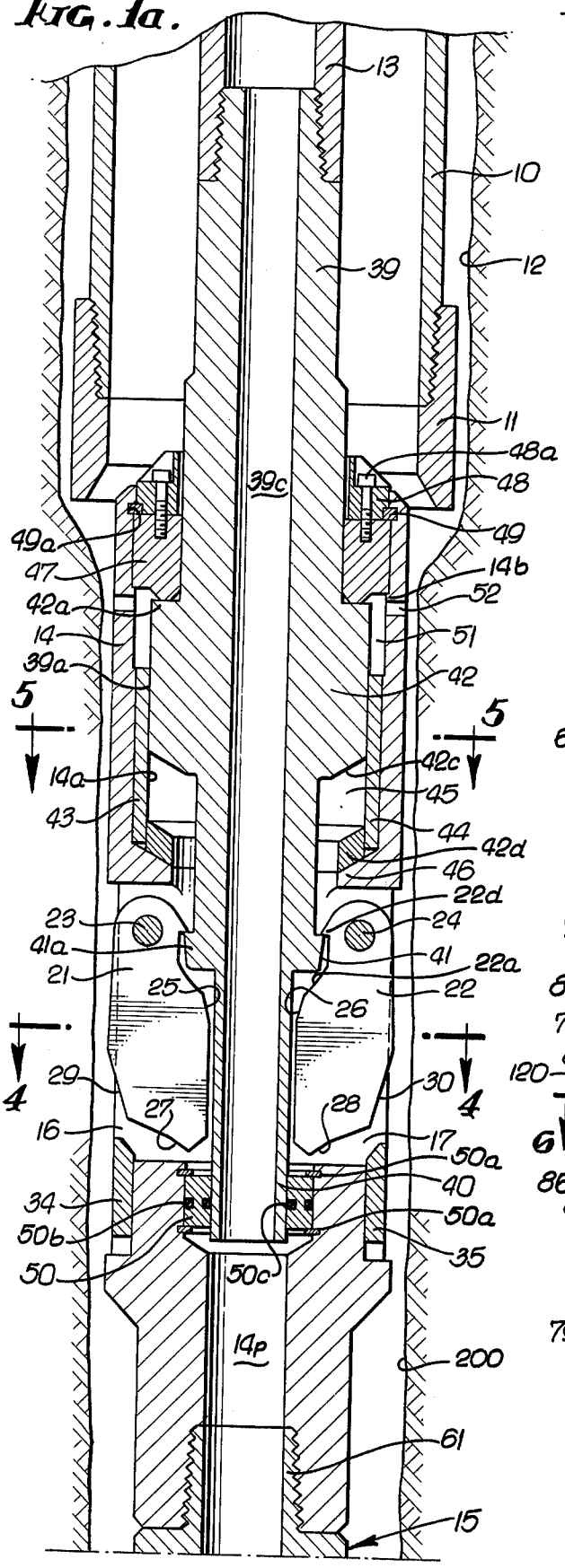

As illustrated in the drawings, a well bore or other bore hole has been drilled through a formation to a predetermined diameter slightly less than the inside diameter of a string of well casing 10, 11 previously installed in the hole. It is desired to enlarge the diameter of the bore hole 200 through use of an expansible drill bit 15 which may be of any known type, such as illustrated in U.S. Pat. No. 3,101,124, and to stabilize the bit in the enlarged well bore through use of an expansible type of stabilizer connected to the drill bit directly or indirectly, the stabilizer itself being secured to the lower end of a string of drill pipe 13 extending to the top of the well bore and rotated through the usual rotary table or the like. (not shown)

Figure 5:
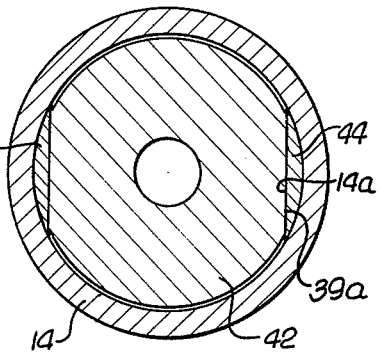

The drill bit includes a mandrel 60 having an upper pin 61 threadedly connected to the lower end of the tubular main body 14 of the stabilizer. If desired, intervening drill pipe or drill collars (not shown) can be secured to and between the stabilizer and the drill bit. A kelly or mandrel 39 is also slidably splined to this body 14 by virtue of the non-circular exterior 39*a* of a portion 42 of the kelly being disposed within a companion non-circular bore 14*a* in the body of the tool. The non-circular kelly exterior 39*a* and bore 14*a* can be achieved in any suitable manner. As disclosed, a pair of opposed shoes 43, 44 are mounted in the body bore or socket and suitably welded thereto, the flat faces of these shoes engaging companion opposed flat surfaces on the exterior of the kelly or mandrel (FIG. 5). The kelly extends upwardly from the body and has a threaded pin threadedly attached to the lower end of the string of drill pipe 13 extending to the top of the well bore. Upward movement of the mandrel with respect to the body is limited by engagement of an upwardly facing shoulder 42*a* on the mandrel with a stop ring 47 resting on an upwardly facing shoulder 14*b* on the body, the stop ring being held in place by a snap ring 49 fitting within a circumferential internal groove 49*a* in the body. Overlying the head, a suitable guide 48 is secured to the head by cap screws 48*a*, the upper end of the guide being tapered to facilitate upward passage of the stabilizer past obstructions in the well bore and in the well casing.

Figure 3A:
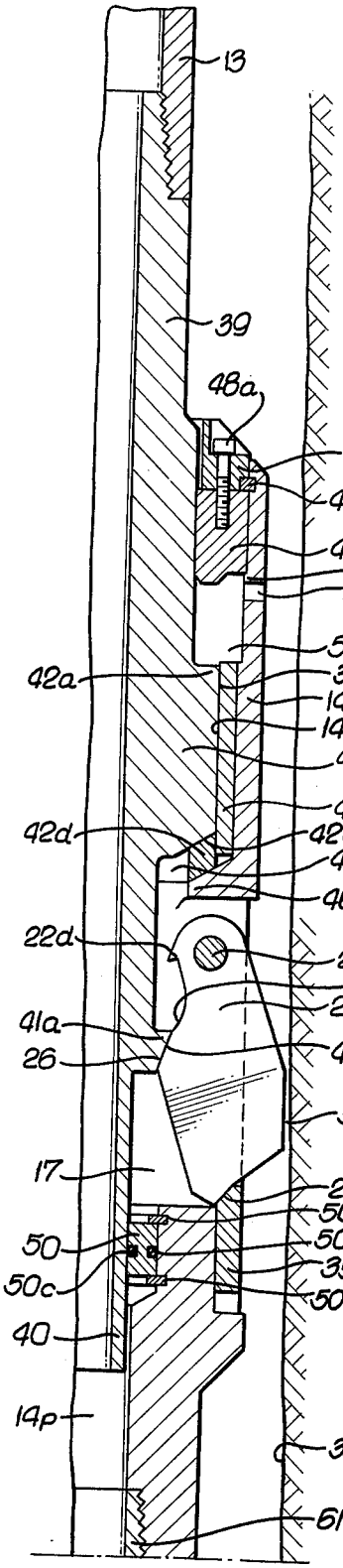

The lower portion of the mandrel 39 extends slidably through a bushing 50 mounted within the body below a plurality of slots 16, 17 extending through the body, the bushing being held in place by upper and lower snap rings 50*a* secured to the body, there being an external seal ring 50*b* on the bushing engaging the body and an internal seal ring 50*c* on the bushing slidably and sealingly engaging the periphery of the lower portion of the mandrel. Stabilizer arms, blades, or ribs 21, 22 are mounted in the body slots 16, 17 for lateral movement between a retracted position, as disclosed in FIG. 1*a*, and a fully expanded position, as disclosed in FIG. 3*a*. The upper portions of these blades are pivotally mounted on hinge pins 23, 24 extending across the slots and suitably secured to the body 14. The mandrel also has an expander member 41*a* thereon engageable with downwardly and inwardly inclined inner surfaces 22*a* on the arms for the purpose of expanding the arms outwardly when the mandrel 39 moves downwardly within the body 14. When the arms have been expanded outwardly to their maximum extent, as determined by engagement of the lower ends 27, 28 of the arms with a stop ring 34, 35 suitably secured to the body of the tool below the slots, the outer backing or holding surfaces 41 on the expander are disposed behind companion surfaces 25, 26 of the arms, to resist inward movement of the arms from their fully expanded position (FIG. 3*a*).

When fully expanded, the outer surfaces 29, 30 of the arms are parallel to the axis of the stabilizer and have an effective diameter substantially the same as the diameter of the enlarged well bore 300. Downward movement of the mandrel 39 within the body is limited by engagement of its downwardly facing shoulder 42*c* with a stop ring 42*d* bearing against an upwardly facing shoulder 46 on the body. Upward movement of the mandrel within the body will cause the expander 41*a* to engage inwardly directed lug portions 22*d* on the arms for the purpose of swinging the arms inwardly within the confines of the main body 14 of the stabilizer. Bleeder holes 52 extend through the body 14 to vent the space 51 around the mandrel portion 42 to permit well bore fluid to enter and leave the space and thereby facilitate longitudinal movement of the mandrel with respect to the body 14. The lower mandrel 60 includes an upper kelly or drill stem member 62 slidably splined to the main body 63 of the drill bit 15. The exterior 64 of the lower portion of the kelly has a noncircular shape being telescopically received in a corresponding shaped socket 65 in the main bit body. As an example, the kelly exterior 64 and the socket 65 may be of hexagonal shape to anable the kelly 62 to move longitudinally relative to the main body 63 while still transmitting rotary motion and torque to the body.

The mandrel 60 has a limited range of longitudinal movement within the body 63, downward movement being determined by engagement of the lower end 66 of the kelly with an inwardly directed body shoulder 67 and its upward movement being limited by engagement of an external shoulder or piston portion 68 of the kelly with a cylinder head 69 secured to the body 63. The upper end of the head has a flange 70 engaging a body shoulder 71, the flange being prevented from moving upwardly of the body by split snap retainer rings 72 fitting within a body groove 73 and overlying the flange 70. An annular guide can be releasably secured to the body 63 by a split snap ring 75 above the retainer rings 72.

Figure 6:
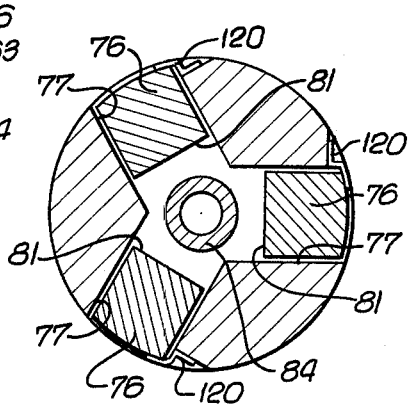
* and FIG. 6 is a cross-section taken along the line 6—6 of FIG. 1*b*.

The body 63 has a plurality of expansible parts mounted on it. These include cutter supporting members 76 pivotally mounted in body slots 77 on hinge pins 78 suitably secured to the body. Each cutter supporting member 76 depends from the hinge pin and rotatably carries a toothed roller cutter 79 at its lower end. As shown in FIGS. 1*b* and 6, the cutter supporting members and the cutters tend to occupy retracted positions substantially entirely within the confines of the main body 63 of the bit. The cutter supporting members 76 and the cutters 79 themselves are expandable outwardly, as when the diameter of the well bore 200 is to be enlarged beyond the inside diameter of the well casing 10, 11 through which the drill bit can be lowered and raised. To accomplish the expansion, each cutter supporting member has an inclined expander surface 80 on its inner portion below the hinge pin 78 which tapers in an inward and downward direction. Each expander surface terminates in a lock surface 81 formed on a lock portion 82 of the cutter supporting member. The outward expansion is accomplished by producing relative longitudinal movement between the mandrel 60 and the bit body 63, which will produce relative longitudinal movement between the cutter supporting members 76 and the tubular member 83 of the mandrel. This tubular member includes a lower portion 84 slidable within a guide bushing 85 mounted within a bridge 86 secured to the body and extending across the body slots 77. This guide bushing 85 is disposed below the lock portion 82 of the cutter supporting members.

Located initially substantially above the guide bushing 85 and below the hinge pins 78, and in cutter member recesses 87, is a mandrel lock and expander 88 which has outer surfaces 89. The lock and expander 88 may be formed integrally with the tubular member 83, the upper end of the latter being piloted within a socket 90 formed in the lower portion of the kelly 62. An enlarged boss 91 on the tubular member engages a downwardly facing shoulder 92 of the kelly, the tubular member 83 being held against this shoulder by a suitable spring retainer lock ring 93 snapped into an internal groove 94 encompassing the kelly socket 90 and engaging the lower end of the tubular member boss 91.

Drilling mud or other fluid can pass down through the central passage 95 in the kelly or drill stem 62 and into the central passage 96 extending completely through the tubular member 83. Leakage of fluid around the exterior of the tubular member 83 is prevented by a suitable side seal ring 97 mounted in a peripheral groove 98 in the kelly and engaging the exterior wall of the boss 91.

Figure 2A:
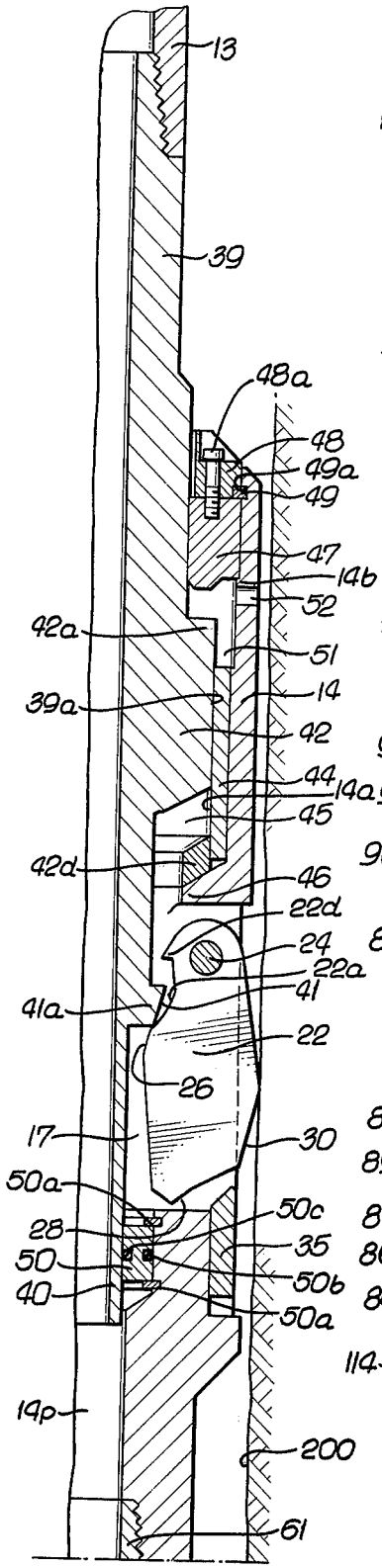
Figure 2B:
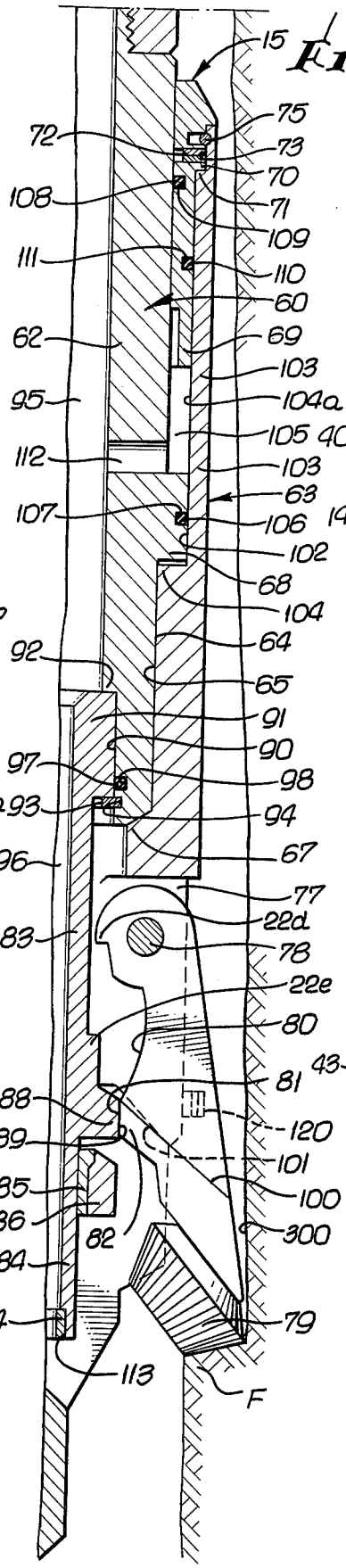
Figure 4:
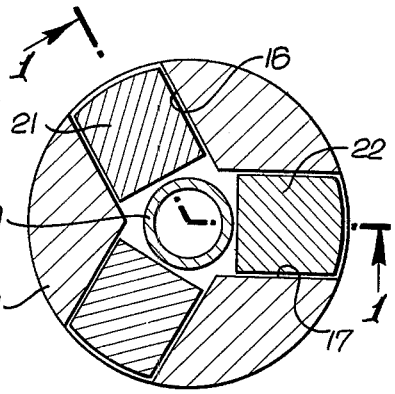
FIG. 4 is a cross-section taken along the line 4—4 on FIG. 1*a;*
Figure 3B:
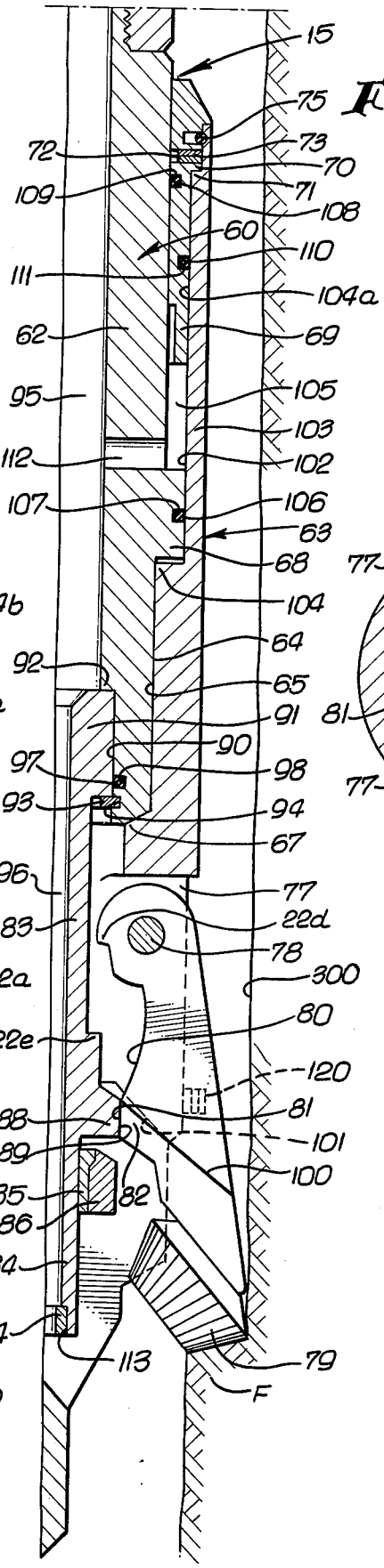

Assuming that the body 63 of the tool is elevated relatively along the tubular mandrel 60, the inclined expander surfaces 80 of the cutter supporting members 76 will be shifted upwardly along the lock and expander portion of the tubular member 83. During such upward shifting, the cutter supporting members 76 and the cutters 79 carried thereby will be pivoted about the hinge pins 78 and urged in an outward direction. Upward movement of the body 63 with respect to the tubular mandrel 60 can continue until the cutters 79 have been shifted outwardly to their fullest extent, as determined by engagement of the stop shoulders 100 on the cutter supporting members 76 with companion shoulder 101 formed in the body on opposite sides of the slots 77. When such engagement occurs, the lower end 66 of the kelly portion of the tubular mandrel will engage the body shoulder 67 and the lock and expander 88 on the tubular member 83 will be disposed behind and in engagement with the lock portions 82 on the cutter supporting members 76. (FIGS. 2*b*, 3*b*).

The relative longitudinal movement between the tubular mandrel 60 and the body 63 of the tool is accomplished hydraulically. As shown in the drawings, the piston or enlarged portion 68 on the drill stem is received within a counterbore 102 formed in the upper portion 103 of the body of the tool, the upper portion actually constituting a cylinder having a cylindrical wall extending from a lower shoulder 104, defining the bottom of the counterbore, to the cylinder head 69. A confined cylinder space 105 is formed between the piston portion 68 of the kelly, the periphery of the kelly above the piston 68, and the cylinder 103, 69. A suitable packing or side seal ring 106 may be disposed in a suitable piston ring groove 107 in the piston 68, which is adapted to slidably seal against the cylindrical wall 104*a* of the cylinder. Fluid is thereby prevented from passing in a downward direction between the piston 68 and the cylinder 103. Similarly, fluid is prevented from passing in an upward direction out of the annular cylinder space 105 by an inner side seal ring 108 carried in an external groove 109 in the cylinder head 69 and slidably and sealingly engaging the periphery of the kelly 62 above the piston 68, and also by an outer side seal ring 110 disposed in an external groove 111 in the head 69 and sealing engaging the cylinder wall 104*a*.

Fluid under pressure in the drill bit collar 13 and in the tubular mandrel passage 95 can be fed into the cylinder space 105 through one or more side ports 112 establishing communication between the central passage 95 through the kelly 62 and the cylinder space. Such fluid under pressure is developed, in the form of invention disclosed in the drawings, by virtue of the fact that the passage 96 through the tubular member 83 of the mandrel is of a restricted diameter as compared to the passage 95 of the kelly portion of the mandrel. As a result, the pumping of drilling mud or other fluid at an adequate rate through the apparatus will build up a back pressure of fluid in the passage 95, which pressure will be imposed on the fluid in the cylinder space 105, acting upon the cylinder head 69 to urge the body 63 of the tool in an upward direction with respect to the tubular mandrel 60, to secure the outward expansion of the cutter supporting members 76 and cutters 79 to their fullest extent, as above described.

In addition to effecting outward expansion of the cutter supporting members 76 and the cutters 79 to their fullest extent, the fluid can pass downwardly out of the passage 96 through the tubular member 83 and will then flow upwardly around the cutters 79, to remove the cuttings and cool the cutters themselves. The cuttings will be flushed upwardly through the annulus between the drill pipe and casing to the top of the hole, for appropriate disposal.

To insure the presence of adequate pressure in the cylinder space 105 during the circulation of fluid while the hole enlarging operation is being conducted, the flow of fluid through the passage 96 is further restricted by a throttle device in the tubular member itself. As shown, the lower portion of the tubular member 83 has a counterbore 113 to receive a tubular sleeve 114, preferably made of a hard metal, such as tungsten carbide, for the purpose of resisting erosive wear. This sleeve 114 can be secured in the lower end of the tubular member 83 in any suitable manner, as by welding. The passage through the sleeve has a smaller diameter than the passage 96.

The supporting members 76 also have inwardly projecting lugs 22*d* engaged by a mandrel shoulder 22*e* for the purpose of mandrel 83 swinging the members 76 and cutters 79 inwardly within the confines of the body 63 when the mandrel is elevated within the body.

During the lowering of the drill bit 15 through fluid in the well bore, pressure is sometimes developed in the mandrel passage 95 that is sufficiently high as to tend to elevate the body 63 of the tool along the mandrel 62, and thereby elevate the cutter supporting members 76 along the mandrel and expander 88, which tends to shift the cutters 79 outwardly against the wall of the well casing. Such expansion may resist downward movement of the cutters 79 in the well casing. In the event that a liner (not shown) is disposed in the well casing 10, through which a rotary drill bit must also pass, even a relatively small expansion of the cutters 79 might prevent the tool from entering and being moved through the liner. Even in the absence of the development of hydraulic pressures, the body 63 of the tool, or the cutter supporting members 76 and cutters 79 are engaging the inner wall of the well casing, tending to resist downward movement of the body therewithin. The mandrel 60 then tends to telescope downwardly in the body 63, causing the expander 88 to engage the expander surfaces 80 on the cutter supporting members 76 and shift the latter and the cutters 79 outwardly.

Inadvertent outward movement of the cutter supporting members 76 and the cutters 79 themselves is prevented in a positive manner without, however, preventing expansion of the cutter supporting members and the cutters when such expansion is desired.

As shown in FIGS. 1*b* and 6, a releaseable retainer 120 is secured to the external portion of the body 63 of the tool and overlies the outer surface of a cutter supporting member 76. If desired, only one of the retainer members 120 can be provided in the drill bit since any tendency for relative longitudinal movement to occur between the mandrel 60 and the body 63 will cause the mandrel expander 88 to engage the expander surface 80 on the cutter supporting member 76 held by the retainer and preclude relative longitudinal movement between the mandrel and the body. However, if desired, a retainer 120 can be provided for each cutter supporting member 76. Each retainer member has spring-like characteristics up to a certain point, so that even if the relative longitudinal movement between the mandrel 60 and body 63 does result in a slight outward expansion of the cutter supporting members 76 and cutters 79, the relieving of the expanding force will cause the retainer members 120 to reshift the cutter supporting members 76 back to their full initial retracted position within the body slot 77.

Figure 1B:
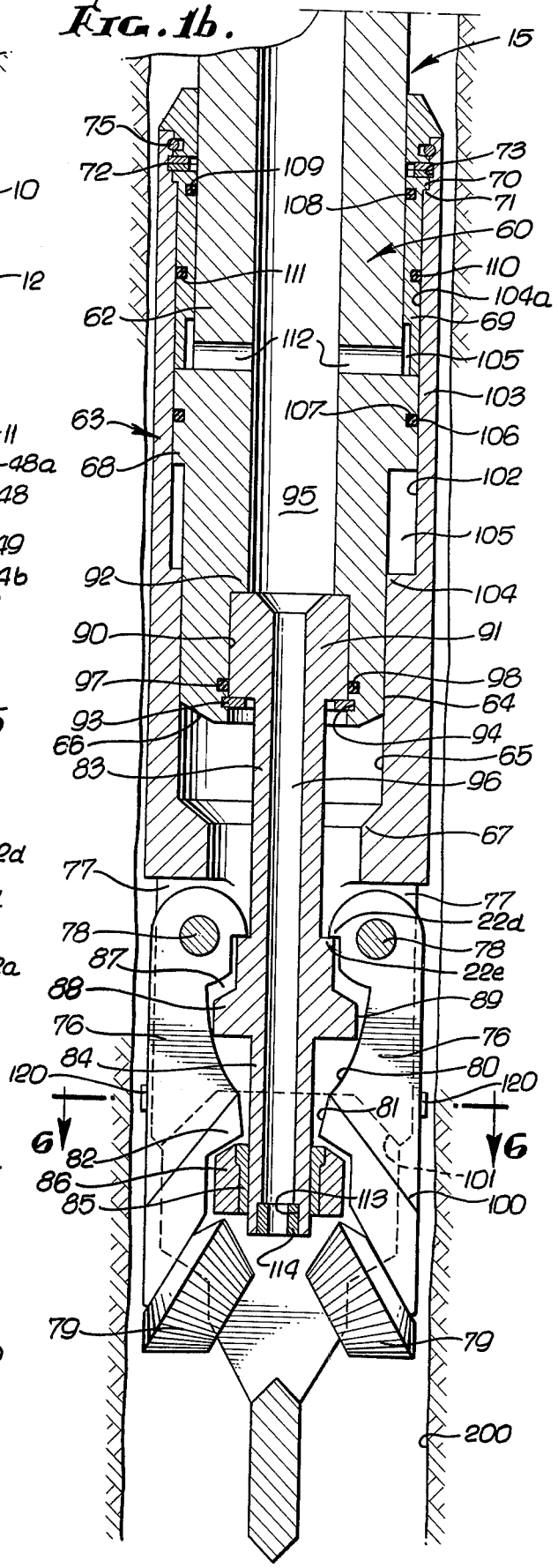

The combination stabilizer and expansible bit apparatus is lowered through the well casing 10 on a string of drill pipe 13 with the stabilizer body 14 in a lower position and the bit body 63 in its lower position with respect to their respective mandrels, the lugs or fingers 22*d* on the respective arms engaging the mandrel shoulders which will retain such arms in their inward positions, as disclosed in FIGS. 1*a* and 1*b*. After the bit has been lowered below the casing shoe 11, its cutters 79 can be expanded by pumping fluid down through the drill string 13, through the central passage 39*c* of the stabilizer mandrel 39 and the lower passage 14*p* of the body into the passage 95, 96 of the bit mandrel, the fluid discharging through the orifice 114, and building up a back pressure in the upper passage 95 of the mandrel, the ports 112, and cylinder 105. Such pressure elevates the body 63, cutter arms 76 and cutters 79 with respect to the mandrel 60 while the apparatus is being rotated at the proper speed, the cutters swinging outwardly about their hinge pins and beginning to penetrate the wall of the bore hole 200. The drill string and apparatus are not lowered at this time, the cutters 79 cutting into the wall of the hole, and as they do so enlarging the hole, the body 63 of the tool progressively moving relatively upwardly along the mandrel 60 until the cutters have been expanded outwardly to their fullest extent, as disclosed in FIGS. 2*b* and 3*b*.

Downweight of the drill string 13 can now be imposed on the stabilizer mandrel 39 which moves downwardly and causes its expander 41*a* to engage the stabilizer arms 21, 22 and swing them outwardly. However, the arms can only swing outwardly to a partial extent, as illustrated in FIG. 2*a*, the downweight being transmitted through the arms and hinge pins 24 to the stabilizer body 14, and from the stabilizer body to the bit mandrel 60. The lower end of the kelly engages the body shoulder 67 so that the drilling weight is transferred directly from the body through the hinge pins 78 and cutter arms 76 to the cutters 79. Drilling in a downward direction proceeds to produce the enlarged hole 300.

When the stabilizer arms 21, 22 reach the enlarged diameter portion of the bore hole, they can swing outwardly to their fullest extent, as disclosed in FIG. 3*a*, at which time the mandrel shoulder 42*c* engages the stop ring 42*d* which, in turn, bears against the body shoulder 46, so that the drilling weight is thereafter transmitted directly from the mandrel 39 to the body 14, and from the body and bit mandrel 60 to the bit body 63, and then to the cutters 79, the parts occupying the positions illustrated in FIGS. 3*a* and 3*b*. The rotation and torque are also transmitted from the drill string stabilizer mandrel 39 to the stabilizer body 14, and from the stabilizer body to the bit mandrel 60 and bit body 63, and then to the supporting arms 76 and cutters 79.

As drilling of the enlarged hole proceeds, the stabilizer arms 21, 22, which are locked in their outward position, with their extended longitudinal external surfaces 29, 30 facing the wall of the well bore in close adjacency thereto, will maintain the hole enlarging bit 15 centered with respect to the axis of the well bore, and thereby prevent deviation of the bit, which would tend to produce a deviated or misaligned enlarged well bore 300. The outer surfaces 29, 30 of the stabilizer arms 21, 22 can, if desired, be hardfaced or may have hardfaced inserts, such as sintered carbide buttons, or the like, mounted thereon, in a known manner, to increase the resistance to wear of the stabilizer arms.

After the well bore has been drilled to its predetermined extent, the drill string 13 is elevated, which will elevate the stabilizer mandrel 39 within the body 14 and cause the expander 41*a* to engage the lugs 22*d* on the stabilizer arms to swing them back to their initial retracted position, as shown in FIG. 1*a*. Continued upward movement of the drill pipe and stabilizer will cause the bit mandrel 60 to be elevated within the bit body 63, its shoulder 22*e* engaging the lugs 22*d* on the cutter supporting members 76 and swinging the cutter supporting members and cutters 79 back to their retracted position, as disclosed in FIG. 1*b*. When the stabilizer arms are in their fully retracted position, the mandrel 39 engages the upper head 47 secured to the body 14; whereas, the bit mandrel 60 will engage the head 69 secured to the bit body 63, the parts then moving as a unit upwardly through the well bore and through the well casing to the top of the hole.

When the stabilizer arms 21, 22 are fully expanded, the mandrel 39 and body 14 are coengaged and function as a unitary body means. Similarly, with the supportive member 76 and cutter 79 fully expanded, the mandrel 60 and body 63 are coengaged and function as a unitary body means. In turn, both body means are rigidly associated with each other for operation as a single unit.

We claim:

1. A stabilized rotary well drilling bit apparatus; comprising rotatable body means connectable to a drilling string, initially retracted, outwardly expandable cutter means mounted on said body means for rotation therewith and for enlarging the diameter of a bore hole to a predetermined extent, initially retracted outwardly expandable stabilizer means trailing said cutter means and mounted on said body means for rotation therewith together with said cutter means, means for effecting joint rotation of said body means, cutter means and stabilizer means during drilling of the enlarged bore hole, means for expanding said cutter means laterally outwardly to enlarge the bore hole to said predetermined extent, and means for expanding said stabilizer means laterally outwardly to a position closely adjacent the wall of the enlarged bore hole.

2. Apparatus as defined in claim 1; and means for limiting the extent of outward expansion of said stabilizer means.

3. Apparatus as defined in claim 2; and means for limiting the extent of outward expansion of said cutter means.

4. Apparatus as defined in claim 1; means mounting said stabilizer means for pivotal movement relative to said body means between retracted and expanded positions.

5. Apparatus as defined in claim 4; and means for limiting the extent of outward expansion of said stabilizer means.

6. Apparatus as defined in claim 5; and means for limiting the extent of outward expansion of said cutter means.

7. Apparatus as defined in claim 1; said body means including an upper body on which said stabilizer means are mounted, said means for expanding said stabilizer means including an upper mandrel shiftable along said upper body; said body means further including a lower body on which said cutter means are mounted, said means for expanding said cutter means including a lower mandrel shiftable along said lower body.

8. Apparatus as defined in claim 7; and means for limiting the extent of outward expansion of said stabilizer means.

9. Apparatus as defined in claim 8; and means for limiting the extent of outward expansion of said cutter means.

10. Apparatus as defined in claim 7; means mounting said stabilizer means for pivotal movement on said upper body between retracted and expanded positions;

and means mounting said cutter means for pivotal movement on said lower body between retracted and expanded position.

11. Apparatus as defined in claim 10; and means for limiting the extent of outward expansion of said stabilizer means.

12. Apparatus as defined in claim 11; and means for limiting the extent of outward expansion of said cutter means.

13. A stabilized rotary well drilling bit apparatus; comprising body means connectable to a drilling string: outwardly expandable cutter means mounted on said body means for enlarging the diameter of a bore hole; outwardly expandable stabilizer means positioned above said cutter means and mounted on said body means; means for expanding said cutter means laterally outwardly; and means for expanding said stabilizer means laterally outwardly to a position adjacent the wall of the enlarged bore hole; said body means including an upper body on which said stabilizer means are mounted, said means for expanding said stabilizer means including an upper mandrel shiftable along said upper body; said body means further including a lower body on which said cutter means are mounted, said means for expanding said cutter means including a lower mandrel shiftable along said lower body; means connecting said lower mandrel to said upper body, said upper mandrel having means thereon adapted for connection to a drill string.

14. Apparatus as defined in claim 10; and means connecting said lower mandrel to said upper body, said upper mandrel having means thereon adapted for connection to a drill string.

15. Apparatus as defined in claim 1; said stabilizer means comprising arms pivotally mounted on said body means; and means for limiting the extent of outward expansion of said arms.

16. Apparatus as defined in claim 15; said body means including an upper body on which said arms are mounted; said means for expanding said arms including an upper mandrel shiftable along said upper body, said body means further including a lower body on which said cutter means are mounted, said means for expanding said cutter means including a lower mandrel shiftable along said lower body.

17. Apparatus as defined in claim 16; means connecting said lower mandrel to said upper body, said upper mandrel having means thereon adapted for connection to a drill string.

18. A stabilizer for use in a bore hole, comprising a body, stabilizer members pivotally mounted on said body about axes transverse to the axis of said body for rotation therewith and for shifting between retracted and expanded positions, means for expanding said members laterally outwardly of said body for engagement with the wall of the bore hole, means for limiting the extent of outward expansion of said members, the outer surfaces of said stabilizer members being elongate and substantially parallel to the axis of said body when said members are fully expanded outwardly of said body, said outer surfaces being arcuate and of uninterrupted extent to enable said members to slide circumferentially around the wall of the bore hole when said members are in their fully expanded position.

19. A stabilizer as defined in claim 18; said expanding means including a mandrel shiftable along said body.

20. Apparatus as defined in claim 19; said mandrel having means thereon for connection to a drill string.

* * * * *